US011680711B2

(12) United States Patent
Dunaway

(10) Patent No.: US 11,680,711 B2
(45) Date of Patent: Jun. 20, 2023

(54) VORTEX SHIELD FOR A GAS BURNER

(71) Applicant: Haier US Appliance Solutions, Inc., Wilmington, DE (US)

(72) Inventor: Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/392,721

(22) Filed: Aug. 3, 2021

(65) Prior Publication Data

US 2023/0037306 A1 Feb. 9, 2023

(51) Int. Cl.
*F24C 3/12* (2006.01)

(52) U.S. Cl.
CPC ..... *F24C 3/126* (2013.01)

(58) Field of Classification Search
CPC ..... F24C 3/126; F24C 3/085; F24C 3/122
USPC ..... 126/39 R, 39 E
See application file for complete search history.

(56) References Cited

U.S. PATENT DOCUMENTS

| | | | | |
|---|---|---|---|---|
| 5,697,776 | A | 12/1997 | Bloomer | |
| 6,457,970 | B1 * | 10/2002 | Park | F23D 14/06 431/348 |
| 9,557,051 | B2 | 1/2017 | Chen | |
| 2017/0138603 | A1 * | 5/2017 | Larsen | F24C 3/085 |
| 2018/0100655 | A1 | 4/2018 | Aguilar | |

* cited by examiner

*Primary Examiner* — Vivek K Shirsat
(74) *Attorney, Agent, or Firm* — Dority & Manning, P.A.

(57) ABSTRACT

A gas burner of a cooktop appliance includes an annular burner body extending along the circumferential direction with an annular fuel plenum defined within the annular burner body. A plurality of ports are defined in the annular burner body. Each port of the plurality of ports extends from the annular fuel plenum inward towards a center of the gas burner assembly. The gas burner assembly also includes a vortex shield inward of the annular burner body along the radial direction. The vortex shield is positioned and configured to redirect a flow of unignited fuel from the ports away from the center of the gas burner assembly.

15 Claims, 14 Drawing Sheets

VORTEX SHIELD FOR A GAS BURNER

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Some users prefer gas burners over electric heating elements due to the adjustability of gas burners. In particular, a gas burner's control valve can provide more heat outputs compared to the discrete number of output settings available for electric heating elements.

However, gas burners may sometimes experience delayed ignition, which occurs when gas flows to the burner and from ports of the burner for an extended time prior to igniting. In such instances, the accumulated gas may suddenly ignite all at once. This quick ignition of a larger than expected amount of fuel can result in undesired effects, such as a loud pop sound.

Accordingly, a gas burner with features to prevent or minimize accumulation of unignited fuel therein would be useful.

BRIEF DESCRIPTION OF THE INVENTION

Aspects and advantages of the invention will be set forth in part in the following description, or may be apparent from the description, or may be learned through practice of the invention.

In one example embodiment, a cooktop appliance is provided. The cooktop appliance defines a vertical direction, a lateral direction, and a transverse direction. The vertical direction, the lateral direction, and the transverse direction are mutually perpendicular. The cooktop appliance includes a top panel with a gas burner assembly positioned at the top panel. The gas burner assembly defines an axial direction generally parallel to the vertical direction, a radial direction perpendicular to the axial direction, and a circumferential direction extending around the axial direction. The gas burner assembly includes an annular burner body extending along the circumferential direction with an annular fuel plenum defined within the annular burner body. A plurality of ports are defined in the annular burner body. Each port of the plurality of ports extends from the annular fuel plenum inward towards a center of the gas burner assembly. The gas burner assembly also includes a vortex shield inward of the annular burner body along the radial direction. The vortex shield is positioned and configured to redirect a flow of unignited fuel from the ports away from the center of the gas burner assembly.

In another example embodiment, a gas burner assembly for a cooktop appliance is provided. The gas burner assembly defines an axial direction, a radial direction perpendicular to the axial direction, and a circumferential direction extending around the axial direction. The gas burner assembly includes an annular burner body extending along the circumferential direction with an annular fuel plenum defined within the annular burner body. A plurality of ports are defined in the annular burner body. Each port of the plurality of ports extends from the annular fuel plenum inward towards a center of the gas burner assembly. The gas burner assembly also includes a vortex shield inward of the annular burner body along the radial direction. The vortex shield is positioned and configured to redirect a flow of unignited fuel from the ports away from the center of the gas burner assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
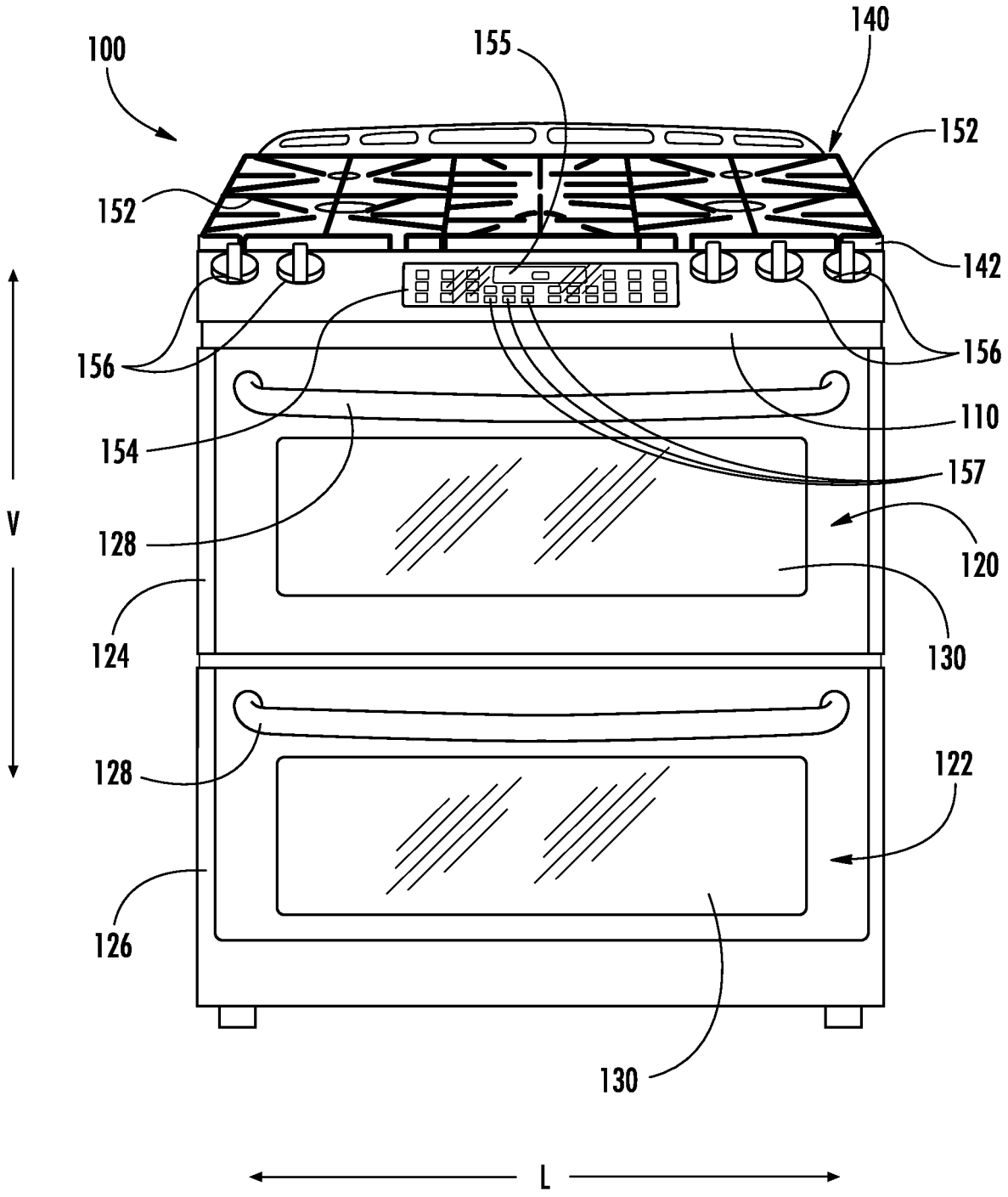
FIG. 1 provides a front, perspective view of a range appliance according to one or more example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
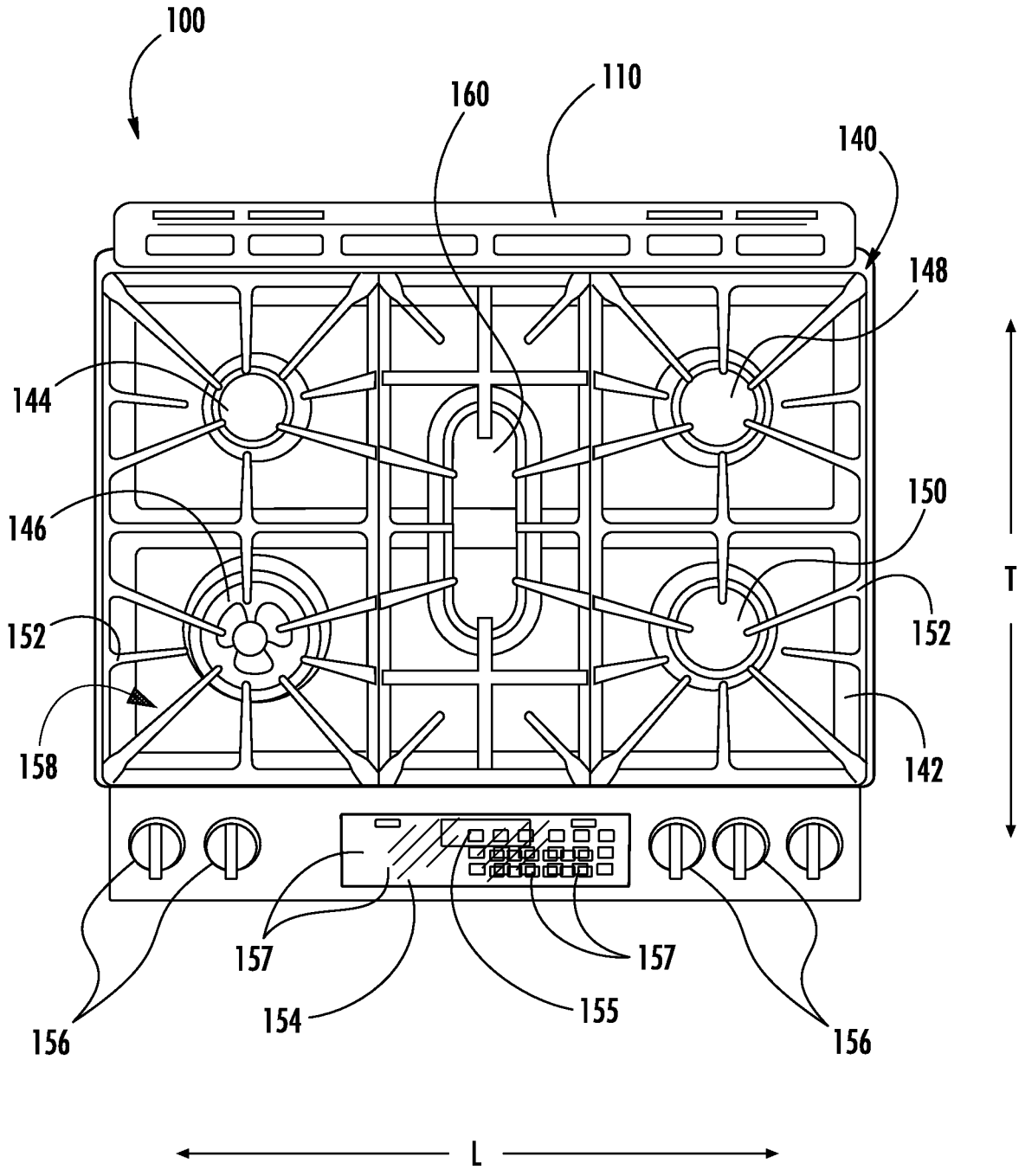
FIG. 2 provides a top, overhead view of the example range appliance of FIG. 1.

FIG. 1 provides a front, perspective view of a range appliance 100 as may be employed with the present subject matter. FIG. 2 provides a top, overhead view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable cooktop appliance, e.g., a single oven range appliance or a standalone cooktop appliance. Thus, the example embodiment shown in FIG. 1 is not intended to limit the present subject matter to any particular cooking chamber configuration or arrangement (or even the presence of a cooking chamber at all, e.g., as in the case of a standalone cooktop appliance).

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 2, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. The user interface panel 154 may also include one or more inputs 157, such as buttons or a touch pad, for selecting or adjusting operation of the range appliance 100, such as for selecting or initiating a precision cooking mode, as will be described in more detail below. User interface panel 154 may also be provided with one or more graphical display devices 155 that deliver certain information to the user such as e.g., whether a particular burner assembly is activated and/or the temperature at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device 155, designed to provide operational feedback to a user.

An exemplary gas burner assembly 200 according to one or more embodiments of the present disclosure is illustrated in FIGS. 3 through 7. The gas burner assembly 200 may be incorporated into an oven appliance or other cooktop appliance, such as the exemplary range appliance 100 illustrated in FIGS. 1 and 2. For example, any one or more of the burner assemblies 144, 146, 148, 150 may be the gas burner assembly 200 and/or may incorporate features thereof.

Figure 3:
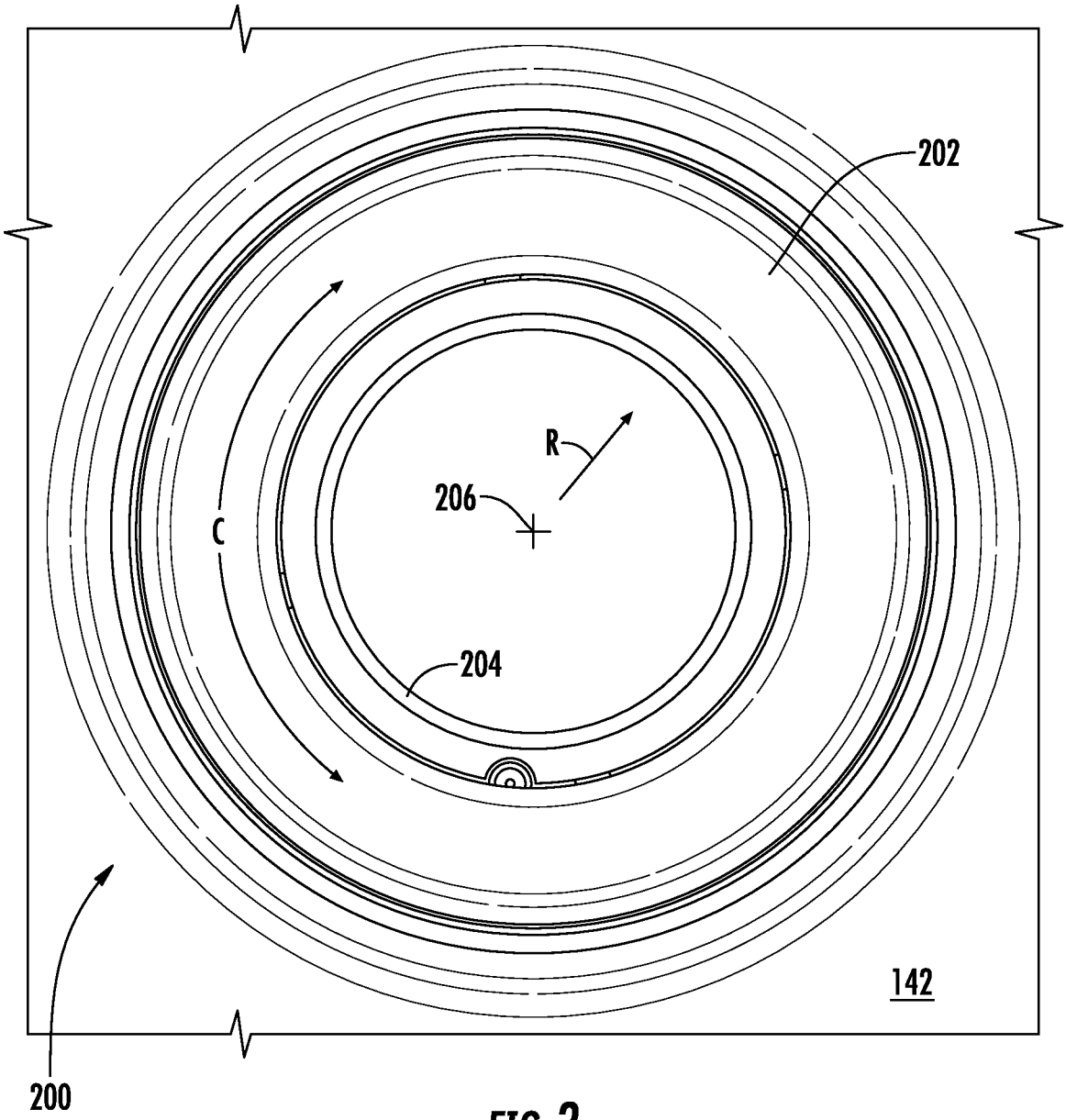
FIG. 3 provides top, overhead view of an exemplary gas burner assembly according to one or more example embodiments of the present subject matter, which may be incorporated into a cooktop appliance such as the example range appliance of FIG. 1.
Figure 4:
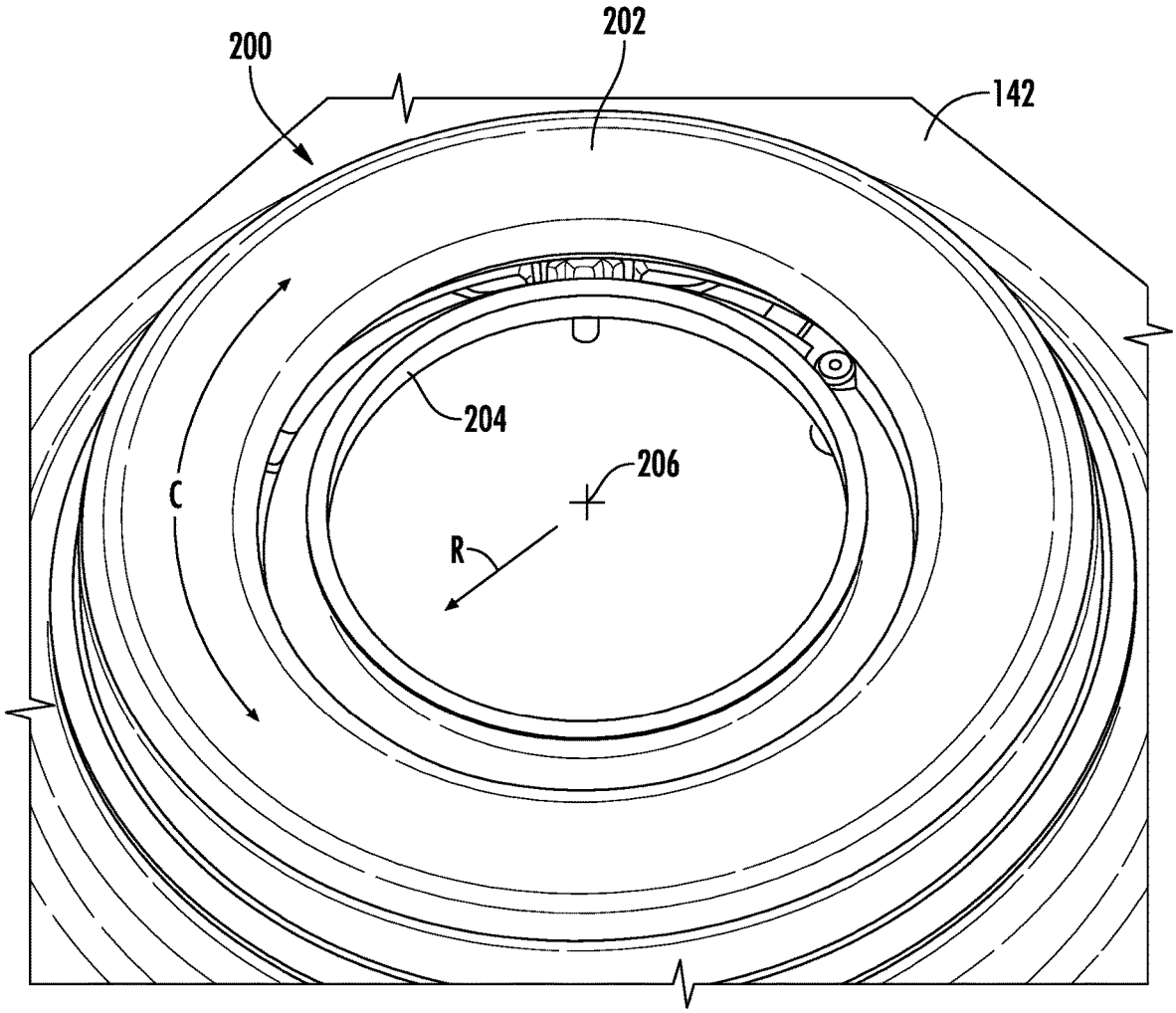
FIG. 4 provides a perspective view of the gas burner assembly of FIG. 3.

Referring now specifically to FIGS. 3 and 4, FIG. 3 provides a top-down, plan, view of the exemplary gas burner assembly 200 and nearby portions of the top panel 142, while FIG. 4 provides a perspective view of the gas burner assembly 200 and part of the top panel 142. The gas burner assembly 200 may define an axial direction A (see, e.g., FIG. 6), a circumferential direction C extending around the axial direction A, e.g., extending around a center 206 of the gas burner assembly 200, and a radial direction R perpendicular to the axial direction A. As may be seen in FIGS. 3 and 4, the gas burner assembly 200 includes an annular burner body 202 and a vortex shield 204. For example, the annular burner body 202 may extend along the circumferential direction C. The vortex shield 204 may be located inward of the annular burner body 202, e.g., the vortex shield 204 may be positioned inward of the annular burner body 202 along the radial direction R.

Figure 5:
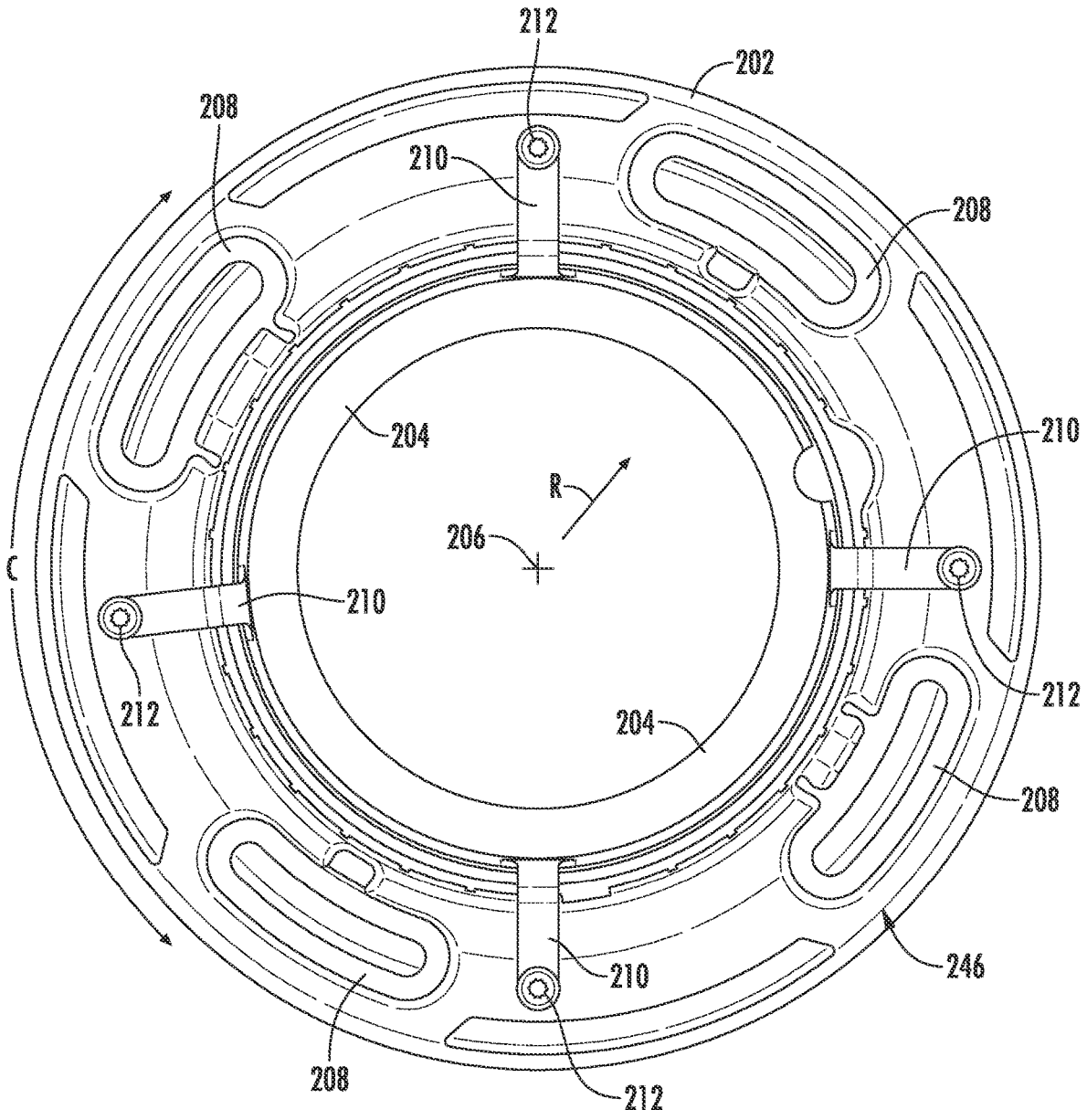
FIG. 5 provides a bottom view of the gas burner assembly of FIG. 3.

FIG. 5 provides a bottom view of a portion of the exemplary gas burner assembly 200, in particular the portion of the gas burner assembly 200 which is positioned on and above the top panel 142. As may be seen in FIG. 5, the vortex shield 204 may be mounted to a bottom side 246 of the annular burner body 202. For example, in some embodiments, the vortex shield 204 may include a plurality of legs 210, and each leg 210 may be fastened to the bottom side 246 of the annular burner body 202 by a respective mechanical fastener 212, e.g., a bolt 212.

Figure 6:
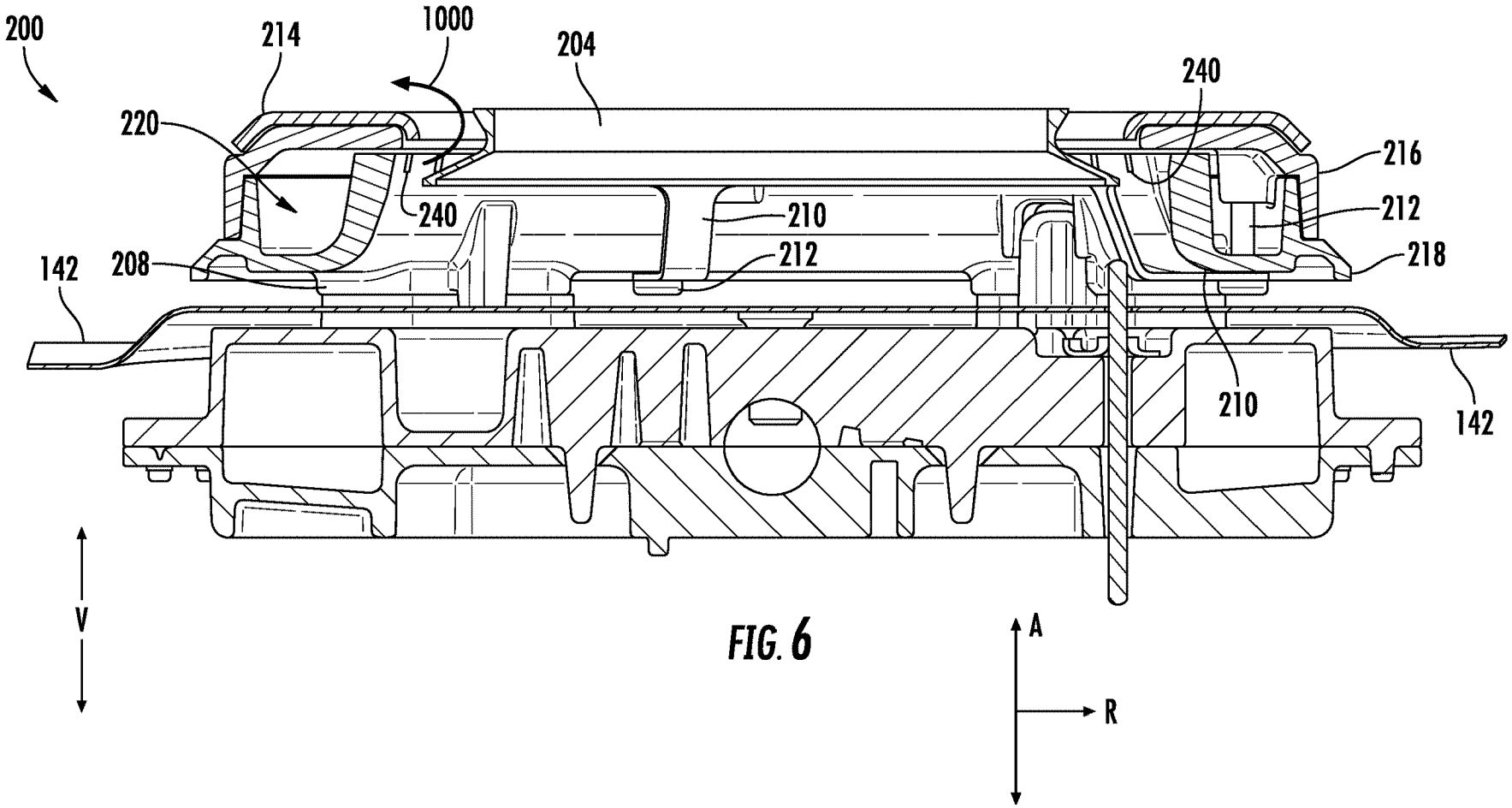
FIG. 6 provides a section view of the gas burner assembly of FIG. 3.

As may be seen in FIG. 6, an annular fuel plenum 220 may be defined within the annular burner body 202. As will be recognized by those of ordinary skill in the art, the annular fuel plenum 220 may be fluidly coupled to a fuel supply, e.g., at ports 208 defined in and through the annular burner body 202, whereby the fuel plenum 220 receives fuel and helps to distribute such fuel circumferentially around the gas burner assembly 200, e.g., through and within the annular burner body 202, and the fuel may then be ignited in order to, e.g., provide heat to a cooking utensil positioned above the gas burner assembly 200, e.g., on grates 152.

Figure 7:
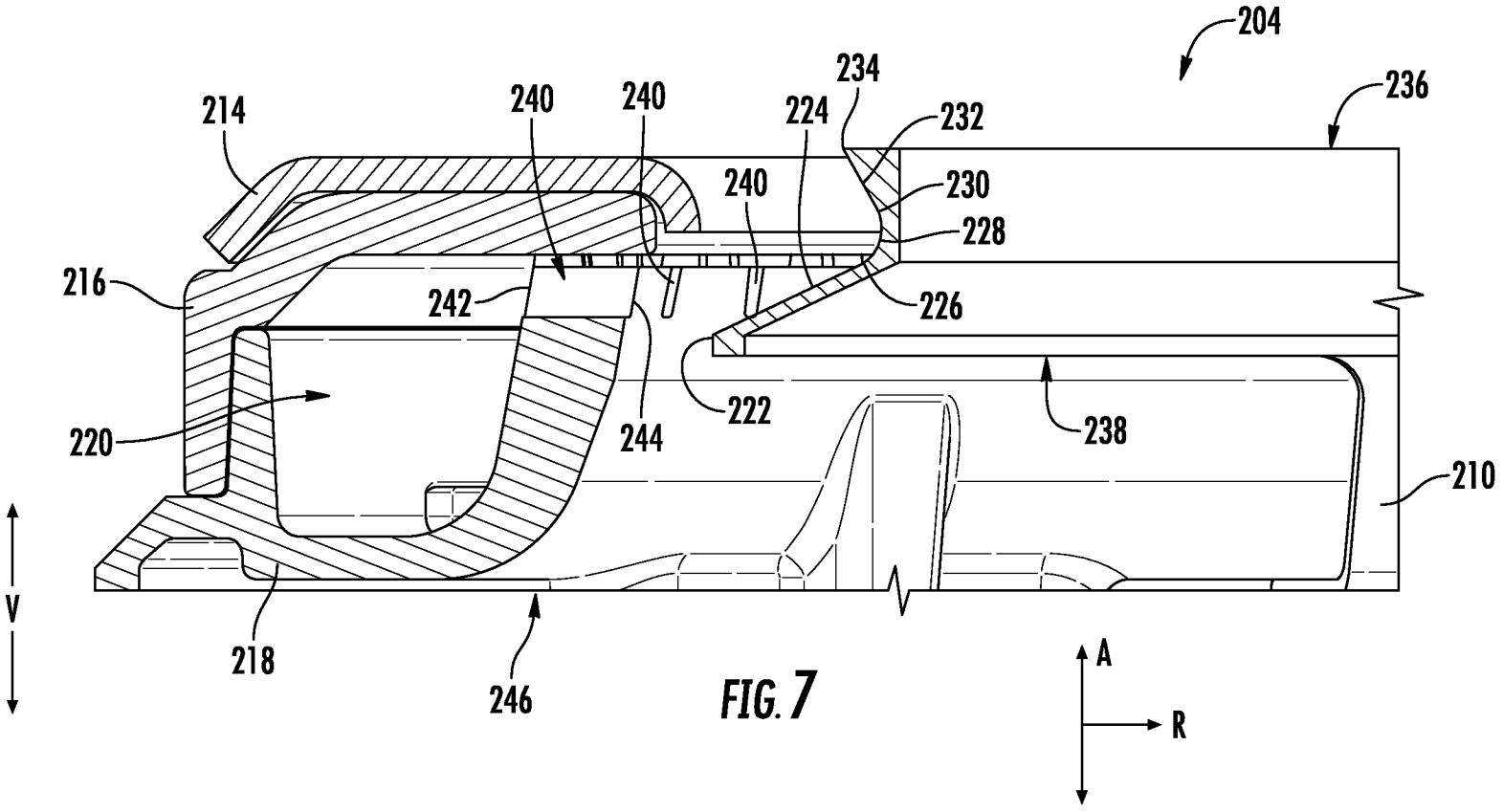
FIG. 7 provides an enlarged section view of a portion of the gas burner assembly of FIG. 3.
Figure 8:
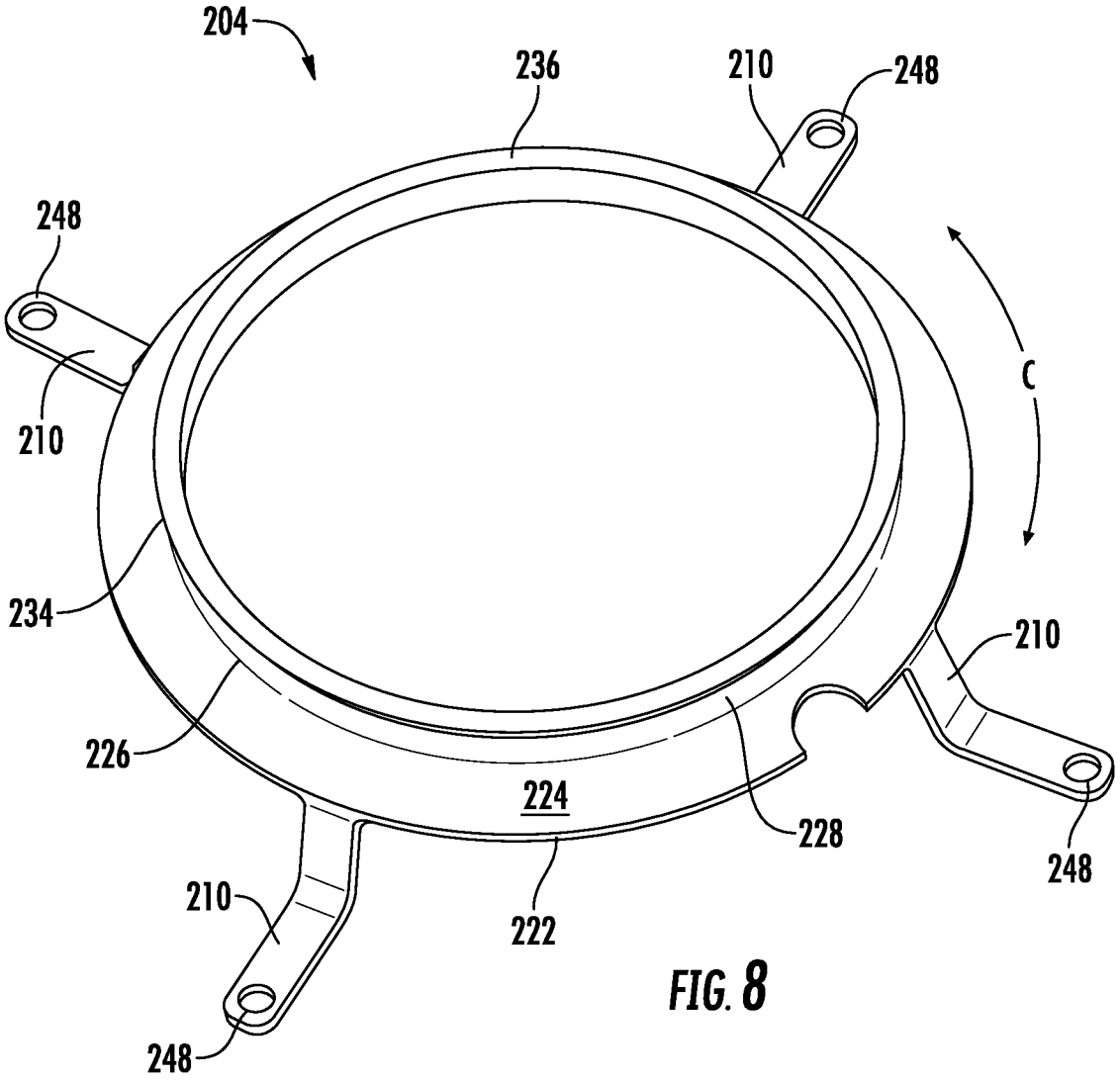
FIG. 8 provides a perspective view of an exemplary vortex shield according to one or more example embodiments of the present subject matter, which may be incorporated into a gas burner assembly such as the gas burner assembly of FIG. 3.
Figure 9:
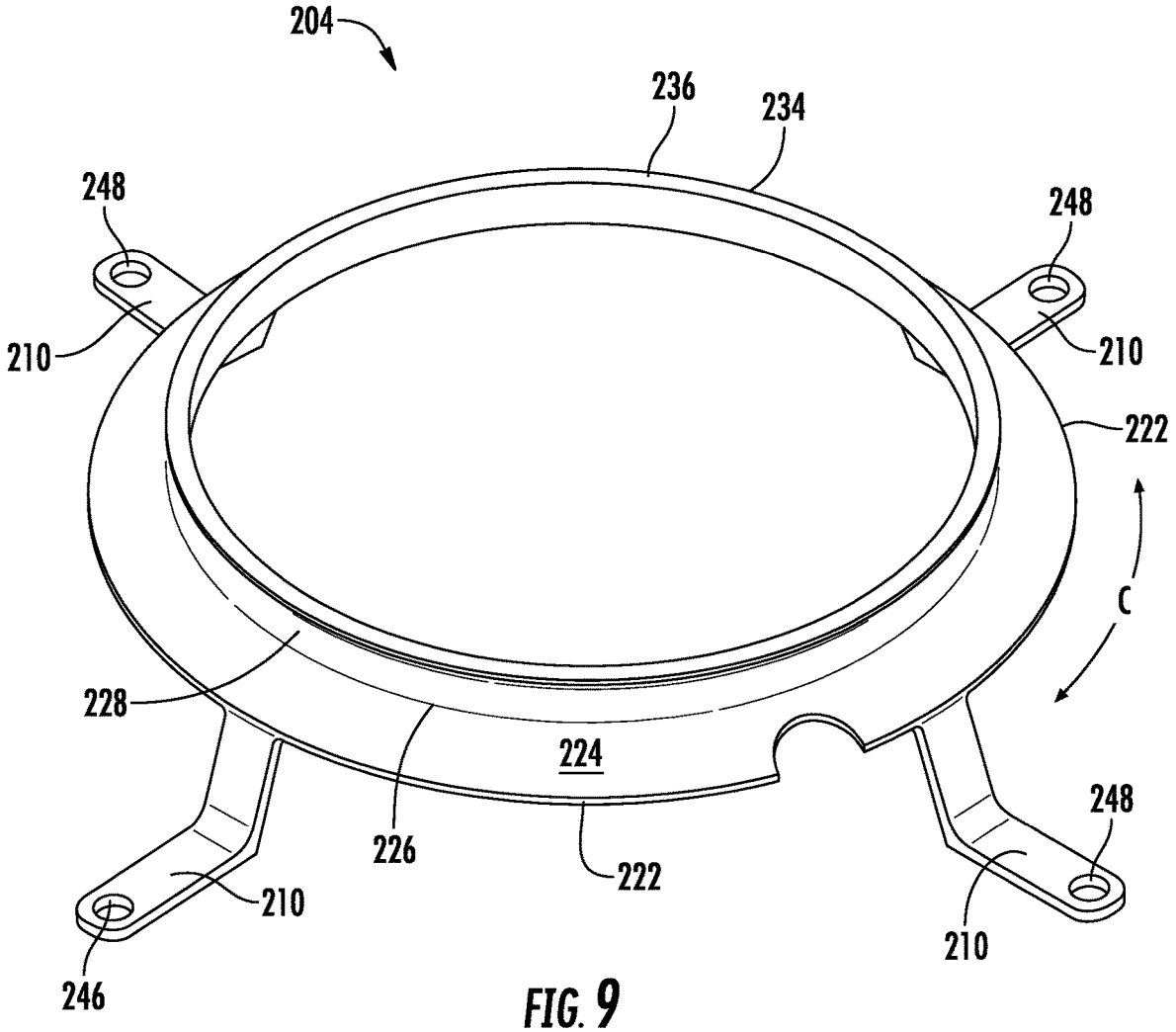
FIG. 9 provides another perspective view of the example vortex shield of FIG. 8.
Figure 10:
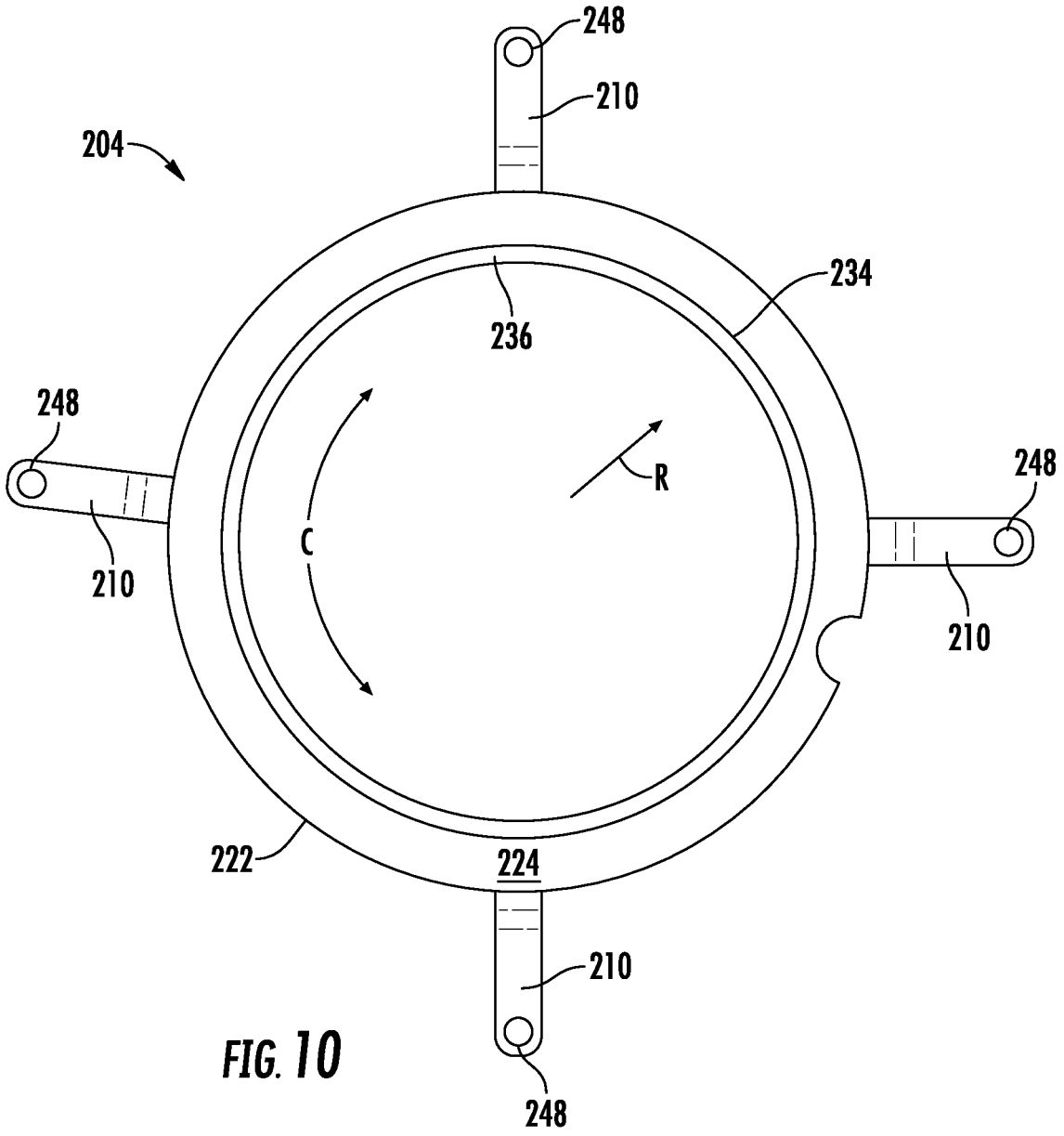
FIG. 10 provides a top view of the example vortex shield of FIG. 8.
Figure 11:
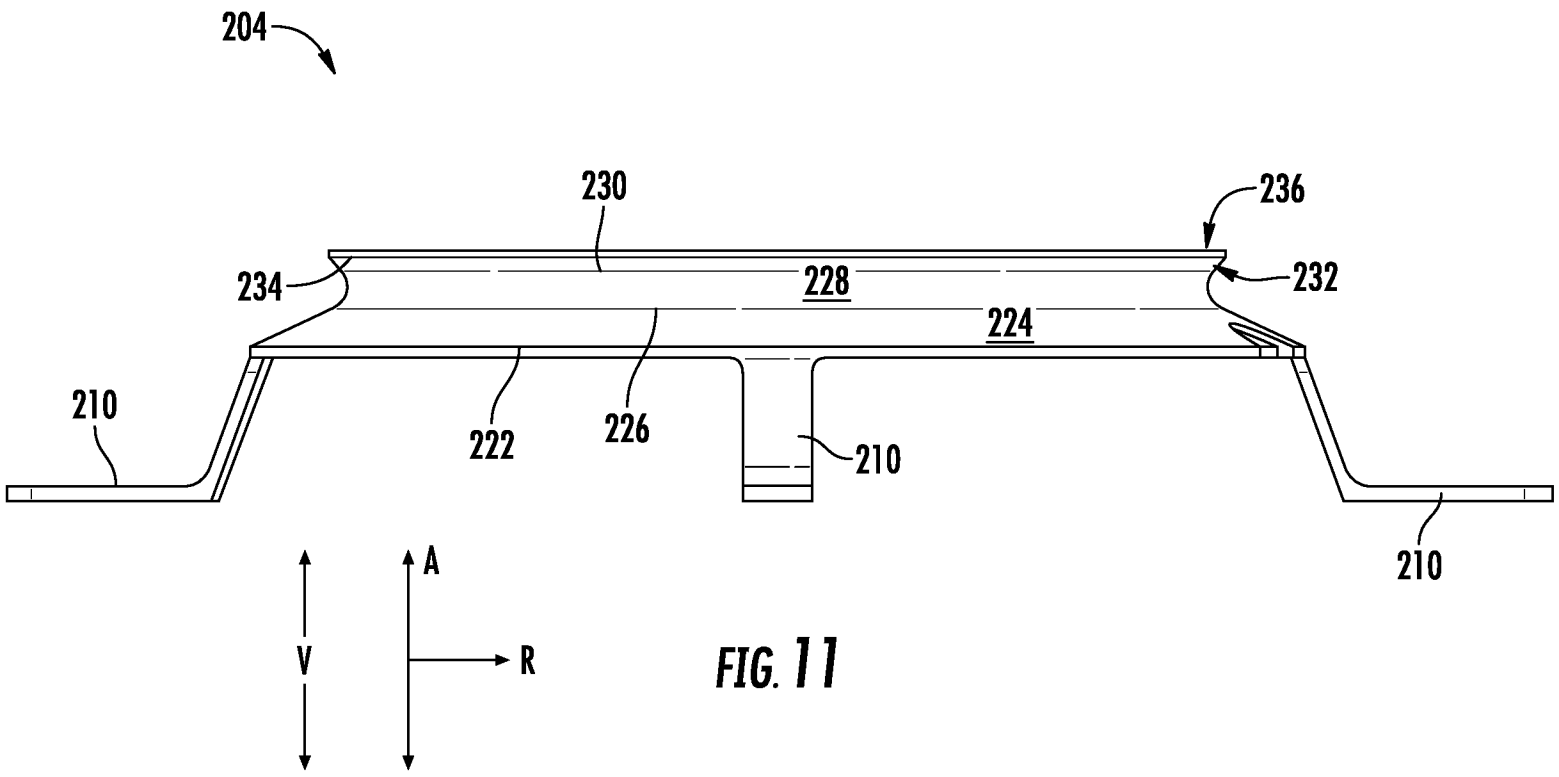
FIG. 11 provides a side view of the example vortex shield of FIG. 8.

As illustrated for example in FIGS. 6 and 7, the annular burner body 202 may include a plurality of ports 240 defined in and through the annular burner body 202. As illustrated in FIG. 7, each port 240 of the plurality of ports 240 may extend from the annular fuel plenum 220 inward, e.g., along the radial direction R, towards the center 206 of the gas burner assembly 200. For example, each port 240 may extend from an inlet 242 adjoining the plenum 220 to an outlet 244 defined in an external surface of the annular burner body 202 and oriented towards the center 206 of the gas burner assembly 200. Thus, the flow of gas that is or will be combusted in the burner assembly 200 is generally radially inward and towards the center 206 of the gas burner assembly 200. With the vortex shield 204 positioned inward of the annular burner body 202 along the radial direction R, the vortex shield 204 is thereby downstream of the ports 240 with respect to the gas flow. Accordingly, the vortex shield 204 may be positioned and configured to redirect a flow of unignited fuel 1000 (FIG. 6) from the ports 240 away from the center 206 of the gas burner assembly 200, as will be described in more detail below.

For example, in some embodiments, the vortex shield comprises a skirt 224 positioned inward of the plurality of ports 240 along the radial direction R. The skirt 224 may also be aligned with the plurality of ports 240 along the radial direction R. In some embodiments, the skirt 224 of the vortex shield 204 may extend from a toe 222 positioned below the plurality of ports 240 along the axial direction A and/or the vertical direction V to a crest 226 positioned above the plurality of ports 240 along the axial direction A and/or the vertical direction V. Thus, when gas 1000 (FIG. 6) flows inward, e.g., towards the center 206, from the center-facing ports 240, the gas 1000 may be diverted before reaching the center 206 by the vortex shield 204, such as by the skirt 224 thereof.

With the bottom, e.g., toe 222, of the skirt 224 below the ports 240 along the vertical direction V and/or axial direction A, the skirt 224 may thereby be positioned to catch all, or generally all, of the gas 1000 from the ports 240. The skirt 224 may also be configured, e.g., shaped, e.g., angled, to then direct the gas (fuel) 1000 upward and away from the gas burner assembly 200, such as away from the center 206 of the gas burner assembly 200, e.g., to or towards a point above the gas burner assembly 200 and/or the center 206 thereof, along the axial direction A and/or the vertical direction V. For example, in some embodiments, the skirt 224 of the vortex shield 204 may extend from the toe 222 to a crest 226 along an oblique angle that extends inward along the radial direction R and upward along the axial direction A. For example, the skirt 224 of the vortex shield 204 may extend from the toe 222 to the crest 226 along a direction that is oblique to the radial direction R and to the axial direction A, e.g., is neither parallel to nor perpendicular to either of the radial direction R or the axial direction A.

In some embodiments, the vortex shield 204 may further be configured to redirect the fuel 1000 away from the gas burner assembly 200, such as away from the center 206 thereof, by redirecting the gas 1000 radially outward and over the annular burner body 202. For example, the vortex shield 204 may further include a ramp 232 above the skirt 224 along the axial direction A and/or along the vertical direction V. In such embodiments, the ramp 232 may extend from a root 230 to an exit 234. In some embodiments, the exit 234 of the ramp 232 may be located at an outer edge 236, e.g., an uppermost edge, of the vortex shield 204. For example, the vortex shield 204 may be bounded along the vertical direction by a lowermost edge 238 and the uppermost edge 236. As may be seen, e.g. in FIGS. 6 and 7, in some embodiments, the ramp 232 may extend outward along the radial direction R and upward along the axial direction A and/or vertical direction V.

Further, in embodiments where the skirt 224 and the ramp 232 are both provided, a radius 228 may be provided between the skirt 224 and the ramp 232. For example, the radius 228 may provide a smooth, transition from the skirt 224 to the ramp 232, e.g., the transition may be smooth in that the geometry thereof promotes a laminar and not turbulent flow of gas 1000 from the skirt 224 to the ramp 232. Thus, in some embodiments, the vortex shield 204 may further include the radius 228 between the skirt 224 and the ramp 232. For example, the radius 228 may adjoin the skirt 224 at a lower end of the radius 228 (where the lower end coincides with the crest 226 of the skirt) and the radius 228 may adjoin the ramp 232 at an upper end of the radius 228 (where the upper end coincides with the root 230 Of the ramp 232).

As may be seen in FIGS. 6 and 7, the annular burner body 202 may be formed of multiple discrete and distinct parts which are fastened together. For example, the annular burner body may comprise a top cover 214, an upper shell 216, and a lower shell 218. In some embodiments, some or all of the parts of the annular burner body 202, e.g., at least the upper shell 216 and the lower shell 218 of the annular burner body 202, may be joined together by a plurality of mechanical fasteners, such as the same mechanical fasteners 212 by which the vortex shield 204 is fastened to the bottom side 246 of the annular burner body 202.

An exemplary vortex shield 204 according to one or more embodiments of the present disclosure is illustrated in FIGS. 8 through 11, where the vortex shield 204 is shown in isolation, e.g., separate from the remainder of the gas burner assembly 200, in order to more clearly depict the vortex shield 204. In some embodiments, e.g., as illustrated in FIGS. 8 through 11, the vortex shield 204 may include the skirt 224 as well as the radius 228 and the ramp 232. Thus, as mentioned above, the vortex shield 204 may, in some embodiments, be positioned and configured to redirect the flow of unignited fuel 1000 from the ports away from the center 206 of the gas burner assembly 200, such as above the center 206, e.g., along the skirt 224, and outward from the center, e.g., along the ramp 232 and/or the radius 228.

Figure 12:
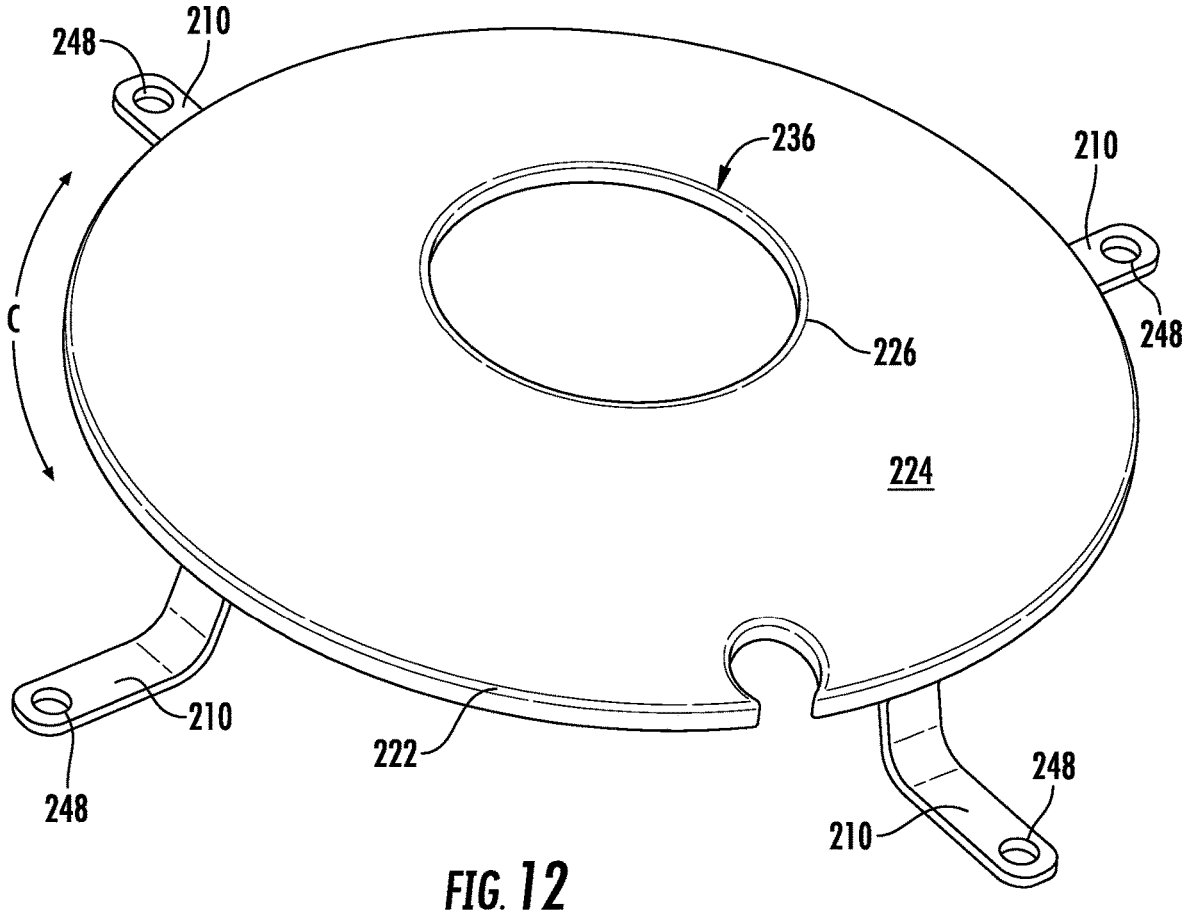
FIG. 12 provides a perspective view of an exemplary vortex shield according to one or more additional example embodiments of the present subject matter, which may be incorporated into a gas burner assembly such as the gas burner assembly of FIG. 3.
Figure 13:
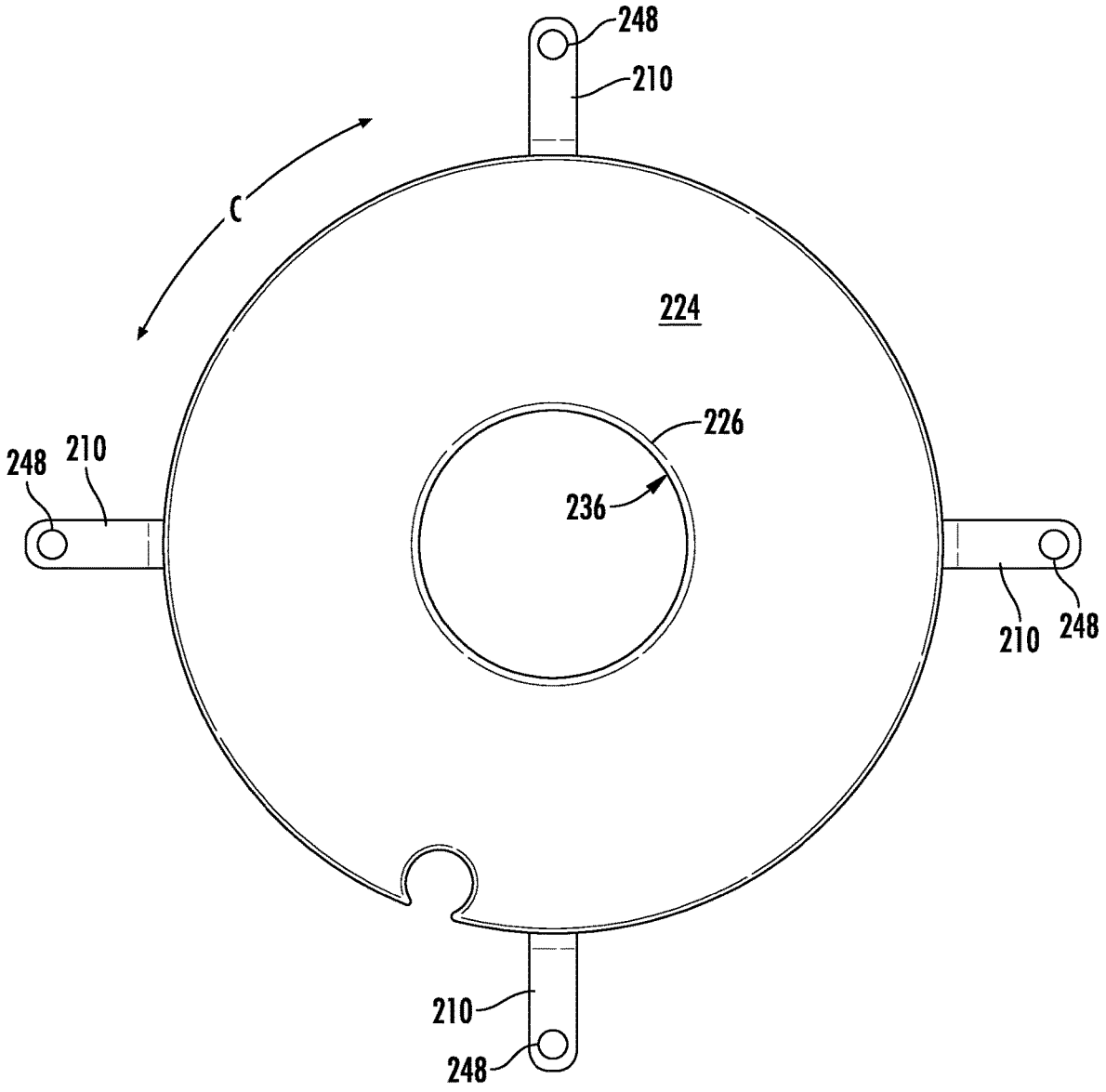
FIG. 13 provides a top view of the example vortex shield of FIG. 12.
Figure 14:
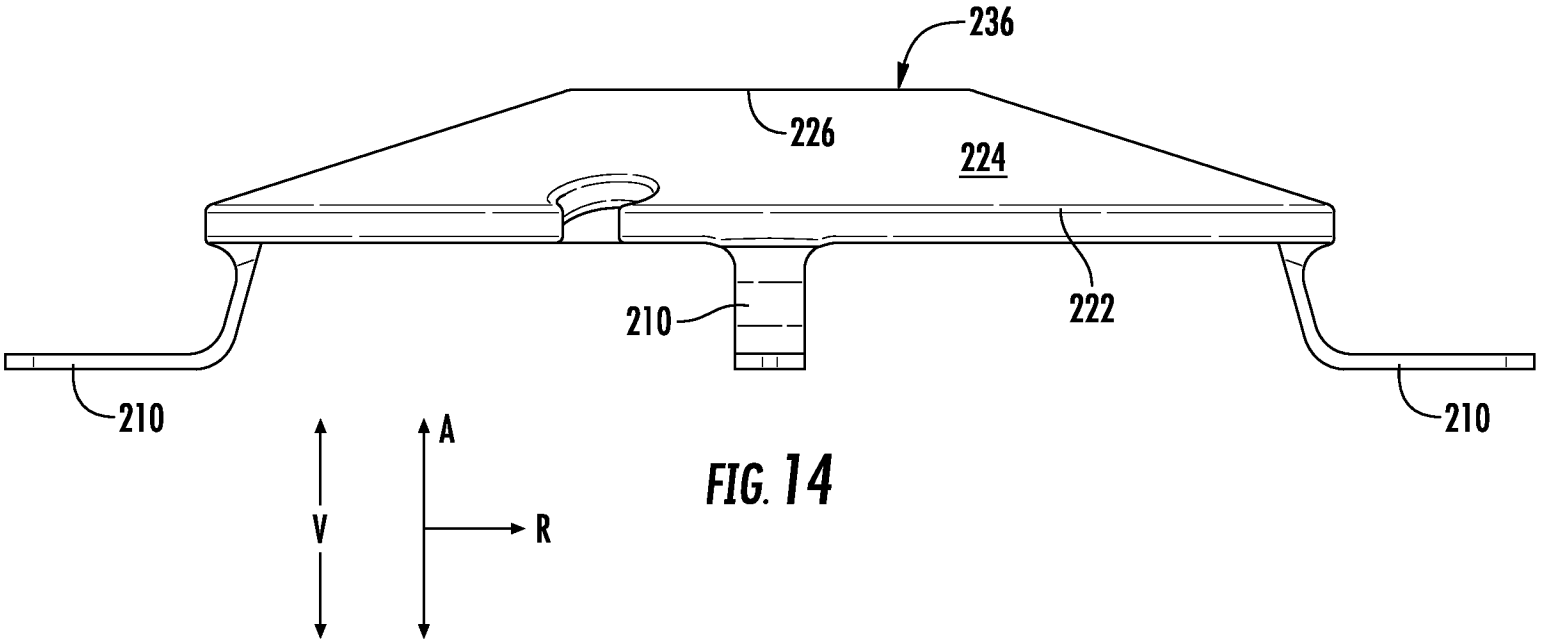
FIG. 14 provides a side view of the example vortex shield of FIG. 12.

An exemplary vortex shield 204 according to one or more additional embodiments of the present disclosure is illustrated in FIGS. 12 through 14. In some embodiments, e.g., as illustrated in FIGS. 12 through 14, the vortex shield 204 may include the skirt 224 only without the radius 228 or the ramp 232. For example, in such embodiments, the crest 226 of the skirt 224 may be located at the uppermost edge 236 of the vortex shield 204. Thus, as mentioned above, the vortex shield 204 may, in some embodiments, be positioned and configured to redirect the flow of unignited fuel 1000 from the ports away from the center 206 of the gas burner assembly 200, such as above the center 206, e.g., along the skirt 224, whereupon the fuel gas may then disperse from the gas burner assembly 200 without accumulating in any one portion or area of the gas burner assembly 200, e.g., in or around the center 206 of the gas burner assembly 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance defining a vertical direction, a lateral direction, and a transverse direction, the vertical direction, the lateral direction, and the transverse direction being mutually perpendicular, the cooktop appliance comprising:

a top panel; and a gas burner assembly positioned at the top panel, the gas burner assembly defining an axial direction generally parallel to the vertical direction, a radial direction perpendicular to the axial direction, and a circumferential direction extending around the axial direction, the gas burner assembly comprising:

an annular burner body extending along the circumferential direction;

an annular fuel plenum defined within the annular burner body;

a plurality of ports defined in the annular burner body, each port of the plurality of ports extending from the annular fuel plenum inward towards a center of the gas burner assembly; and a vortex shield inward of the annular burner body along the radial direction, wherein the vortex shield is positioned and configured to redirect a flow of unignited fuel from the ports away from the center of the gas burner assembly, wherein the vortex shield comprises a skirt positioned inward of the plurality of ports along the radial direction and aligned with the plurality of ports along the radial direction, wherein the vortex shield further comprises a ramp above the skirt along the axial direction, and wherein the ramp extends from a root to an outer edge of the vortex shield upward along the axial direction and outward along the radial direction.

2. The cooktop appliance of claim 1, wherein the skirt of the vortex shield extends from a toe positioned below the plurality of ports along the axial direction to a crest positioned above the plurality of ports along the axial direction.

3. The cooktop appliance of claim 1, wherein the skirt of the vortex shield extends from a toe to a crest inward along the radial direction and upward along the axial direction.

4. The cooktop appliance of claim 3, wherein the skirt of the vortex shield extends from the toe to the crest along a direction that is oblique to the radial direction and to the axial direction.

5. The cooktop appliance of claim 1, wherein the vortex shield further comprises a radius between the skirt and the ramp, the radius adjoining the skirt at a lower end of the radius and adjoining the ramp at an upper end of the radius.

6. The cooktop appliance of claim 1, wherein the vortex shield is mounted to a bottom of the annular burner body.

7. The cooktop appliance of claim 6, wherein the annular burner body comprises an upper shell and a lower shell, the upper shell and the lower shell of the annular burner body joined together by a plurality of mechanical fasteners, and the vortex shield is fastened to the bottom of the annular burner body by the plurality of mechanical fasteners.

8. A gas burner assembly for a cooktop appliance, the gas burner assembly defining an axial direction, a radial direction perpendicular to the axial direction, and a circumferential direction extending around the axial direction, the gas burner assembly comprising:

an annular burner body extending along the circumferential direction;

an annular fuel plenum defined within the annular burner body;

a plurality of ports defined in the annular burner body, each port of the plurality of ports extending from the annular fuel plenum inward towards a center of the gas burner assembly; and a vortex shield inward of the annular burner body along the radial direction, wherein the vortex shield is positioned and configured to redirect a flow of unignited fuel from the ports away from the center of the gas burner assembly, wherein the vortex shield is mounted to a bottom of the annular burner body, and wherein the annular burner body comprises an upper shell and a lower shell, the upper shell and the lower shell of the annular burner body joined together by a plurality of mechanical fasteners, and the vortex shield is fastened to the bottom of the annular burner body by the plurality of mechanical fasteners.

9. The gas burner assembly of claim 8, wherein the vortex shield comprises a skirt positioned inward of the plurality of ports along the radial direction and aligned with the plurality of ports along the radial direction.

10. The gas burner assembly of claim 9, wherein the skirt of the vortex shield extends from a toe positioned below the plurality of ports along the axial direction to a crest positioned above the plurality of ports along the axial direction.

11. The gas burner assembly of claim 9, wherein the skirt of the vortex shield extends from a toe to a crest inward along the radial direction and upward along the axial direction.

12. The gas burner assembly of claim 11, wherein the skirt of the vortex shield extends from the toe to the crest along a direction that is oblique to the radial direction and to the axial direction.

13. The gas burner assembly of claim 9, wherein the vortex shield further comprises a ramp above the skirt along the axial direction.

14. The gas burner assembly of claim 13, wherein the vortex shield further comprises a radius between the skirt and the ramp, the radius adjoining the skirt at a lower end of the radius and adjoining the ramp at an upper end of the radius.

15. The gas burner assembly of claim 13, wherein the ramp extends from a root to an outer edge of the vortex shield upward along the axial direction and outward along the radial direction.

* * * * *